United States Patent [19]

Weber

[11] 4,030,515

[45] June 21, 1977

[54] TELESCOPIC UMBRELLA

[75] Inventor: Heinz Weber, Hilden, Germany

[73] Assignee: Telesco Brophey Limited, Montreal, Canada

[22] Filed: July 19, 1976

[21] Appl. No.: 706,211

[30] Foreign Application Priority Data

July 21, 1975 Germany ..... 2532525
May 3, 1976 Germany ..... 2619052

[52] U.S. Cl. ..... 135/25 R; 135/26; 135/32

[51] Int. Cl.[2] ..... A45B 19/04; A45B 19/06

[58] Field of Search ..... 135/25 R, 26, 32

[56] References Cited

UNITED STATES PATENTS

| | | | |
|---|---|---|---|
| 1,249,007 | 12/1917 | Block | 135/26 X |
| 3,457,931 | 7/1969 | Shimizu | 135/26 X |
| 3,702,618 | 11/1972 | Weber | 135/32 X |
| 3,853,135 | 12/1974 | Schafer | 135/25 R |
| 3,902,514 | 9/1975 | Weber | 135/32 X |

*Primary Examiner*—Werner H. Schroeder
*Assistant Examiner*—Conrad L. Berman
*Attorney, Agent, or Firm*—Alan Swabey & Co.

[57] ABSTRACT

An umbrella frame is described having dome ribs, each including an inner section, a telescopic middle section, and an outer section hingedly connected to the middle section for movement between a position colinear with the middle section and a position with the outer section folded over the middle section. A geats is slidable on the inner section, and a stretcher member is hinged to the main runner as well as to the geats. A second geats member is slidable on the inner section and is connected to the end of the middle dome rib section. An auxiliary runner is slidable on the stick between the main runner and the crown. A strut member is hinged to the auxiliary runner and to the stretcher member, and a control link is hinged to the stretcher member, a short distance from the hinge of the first geats, and at the other end the control link member is pivotally connected to an inner extension of the outer dome rib section. Such a construction allows, as the main runner is slid on the stick away from the crown, the dome ribs to pivot downwardly to a position parallel with the stick as the first geats member slides on the inner dome rib section, leaving the middle dome rib section and the outer dome rib section fully extended, and as the runner is further moved on the stick away from the crown, it will cause the first geats to slide on the dome rib section away from the crown, and a control link will cause the outer dome rib section to fold onto the middle dome rib section.

5 Claims, 6 Drawing Figures

TELESCOPIC UMBRELLA

BACKGROUND OF THE INVENTION

1. Field of the Invention

The present invention relates to improvements in umbrella frames, and more particularly, to umbrella frames of the type which can be collapsed to form a relatively small package when not in use.

2. Description of the Prior Art

This type of umbrella is known from U.S. Pat. No. 3,902,514, issued Sept. 2, 1975,H. Weber, inventor, which discloses an umbrella frame comprising a stick, a crown at the upper end of the stick and a plurality of dome ribs distributed about the crown, each extending in a direction away from the crown. Each of the dome ribs has three sections, with the outermost section pivotable about a pivot point at the outer end of the middle section, and the middle section being telescopic on the inner section hinged to the crown. A main runner slides on the stick, and each dome rib is supported by a support structure, and each support structure includes a stretcher member pivoted to the main runner at one end and to the middle dome rib section at the other end thereof. A strut member is hinged to an auxiliary runner sliding on the stick between the main runner and the crown, and at the other end thereof is hinged to the stretcher member intermediate the hinge points of the stretcher member. A control link is pivoted at one end to a stretcher member at a point spaced from the pivot point of the stretcher member to the dome rib, and the other end of the first link member is hinged to an inward extension of the outer dome rib section forming a quadrilateral with the middle section of the dome ribs and the portion of the stretcher member between the pivot points of the control link member and the dome ribs, and the dome ribs as well as the portion of the extension of the outer dome rib section so as to control the folding of the outer dome rib section from a position folder onto the middle dome rib section to a position extended away from the middle dome rib section and linearly aligned therewith.

The umbrella, in accordance with this patent, automatically folds closed as the runner on the stick is moved towards the handle with the outer dome rib sections immediately folding onto the middle dome rib sections which may then be telescoped within the inner sections. The movement is positive and allows the dome ribs to be collapsed to one-third of its normal length. However, when the cover fabric is wet, there is no way to partially collapse the umbrella so as to allow the umbrella material to dry without folding it and thereby causing the wet cover material to be bunched together and thus delay the drying.

SUMMARY OF THE INVENTION

It is an aim of the present invention to provide an umbrella of the type described in U.S. Pat. No. 3,902,514, but which has an improved structure such that an intermediate folding position can be attained whereby the dome ribs remain substantially fully extended even though the runner is being moved away from the crown and the dome ribs are folded down parallel to the stick.

It is a further aim of the present invention to provide, in combination with the above feature, a simple and positive control for completely folding the umbrella dome ribs.

An umbrella frame, in accordance with the present invention, includes a stick, a crown fixed at one end of the stick, a plurality of dome ribs hinged from the periphery of the crown, a main runner slidable on the stick, each dome rib including an inner section and a middle section telescopic within the inner section, and an outer section hingedly connected to the outer end of the middle section for movement between a position colinear with the middle section and a position with the outer section folded over the middle section, a geats slidable on the inner section, a stretcher member hinged to the main runner at one end thereof and to the geats at the other end thereof, a second geats member slidable on the inner section and connected to the end of the middle dome rib section, an auxiliary runner slidable on the stick, a strut member hinged to the auxiliary runner and to the stretcher member, and a control link hinged to the stretcher member a short distance from the hinge point with the first geats at one end thereof and at the other end of the control link member with an inner extension of the outer dome rib section such that as the main runner is slid on the stick away from the crown, the dome rib section will pivot downwardly to a position parallel with the stick as the first geats member slides on the inner dome rib section, leaving the middle dome rib section and the outer dome rib section fully extended, and as the runner is further moved on the stick to a position beyond the length of the strut member and the portion of the stretcher member between the runner and the pivoting point of the strut to the stretcher member, it will case cause geats to slide on the some rib section away from the crown and the control link will cause the outer dome rib section to fold onto the middle dome rib section.

The advantages of such a construction are, of course, that the dome ribs can be pivoted downwardly parallel to the umbrella stick in their still extended condition, for carrying. If the umbrella cover is wet, the cover can be held stretched out on the dome ribs, but closed against the umbrella stick. When it is necessary to completely collapse the umbrella, it is merely necessary to move the main runner further towards the handle, thereby causing the outer dome rib sectin to fold over by means of the now extended strut and stretcher member now moving the geats towards the end of the inner dome rib section and pushing the control link under compression to force the outer dome rib section to pivot about its connection with the main dome rib section. Once the outer dome rib sections have been folded over, it is merely necessary to collapse the telescopic stick and dome rib sections in one movement.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 4, 5, 6:
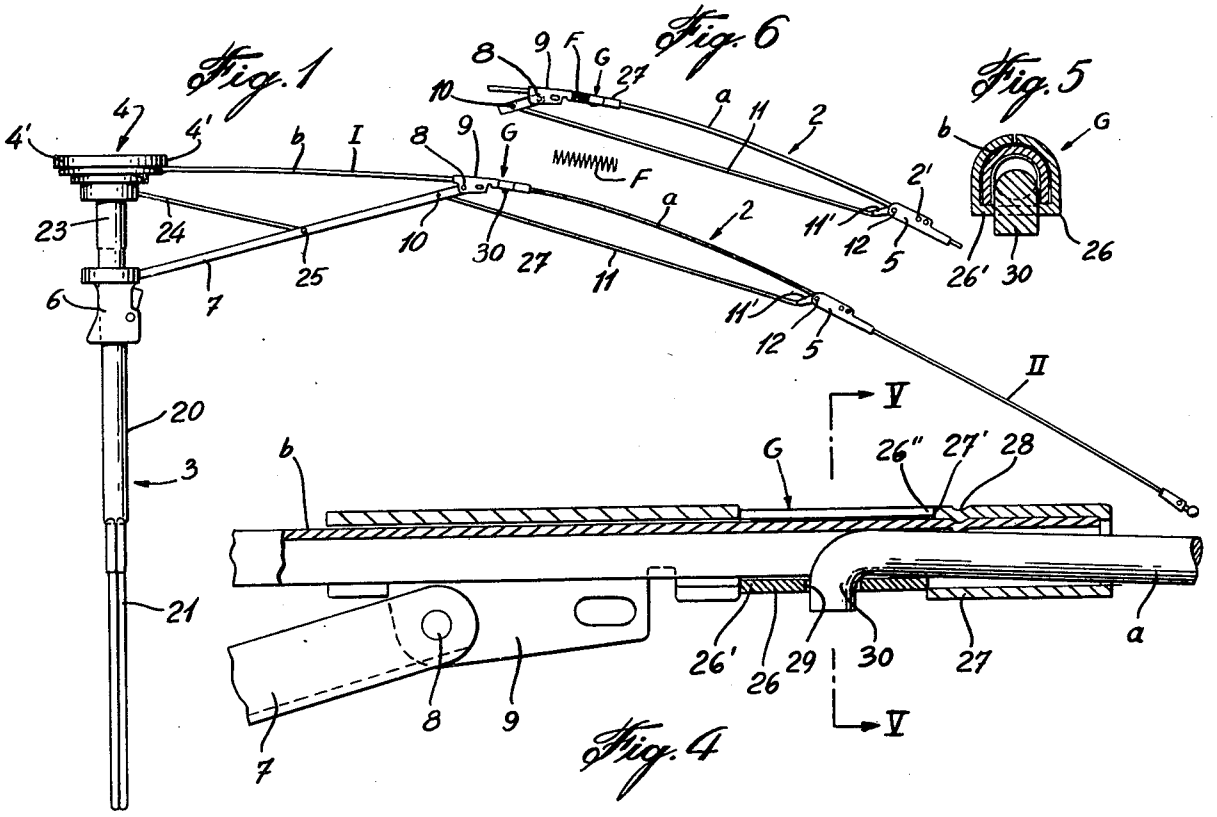
FIG. 1 is a fragmentary elevation of a detail of the umbrella frame in an open position.
FIG. 4 is an enlarged cross-sectional view of a detail of FIG. 1.
FIG. 5 is a cross-section taken along lines V—V of FIG. 4.
FIG. 6 is a fragmentary vire of a detail of a further embodiment of the present invention, and also illustrates an enlarged view of one element included in the detail.

Reference will now be made to FIGS. 1 through 5. The umbrella illustrated in the drawings includes a telescopic stick 3 having telescopic sections 20, 21 and 22.

The crown may be of any shape, such as circular, oval, or rectangular cross-section, and the crown's shape will, of course, determine the cross-section of the closed umbrella frame. In the embodiment illustrated in the drawings, the crown is shown having a rectangular cross-section, section, thereby providing a so-called flat umbrella, in which the dome ribs are hinged to the crown in two groups in diametrically opposed projections 4' of the crown 4. Each dome rib includes two groups of sections, that is, group I and II. Group I includes a pair of telescopic sections *a* and *b*, while group II is a single folding section II. The dome section *a* is of circular rod construction, while the section *b* is of U-shaped construction and includes a cylindrical bushing 27 at the end thereof through which the dome rib section *a* is adapted to slide therethrough. The bushing 27 is fixed to the dome rib section *b* by means of a pressed indentation 28.

A main runner 6 is adapted to slide on the stick. The main runner includes a pivoting latch 13 which is adapted to engage a suitable aperture in the stick section 20 to maintain the umbrella in an open condition as shown in FIG. 1. From the runner 6 there is hinged a plurality of stretcher members 7, one for each dome rib. The stretcher member 7 is hinged to a sliding geats 9 at pivot point 8. Geats 9, which is also of U-shaped construction, is adapted to slide on the dome rib section *b* of group I.

An auxiliary runner 23 is adapted to slide on the stick between the main runner 6 and the crown 4. A plurality of struts 24 are hinged about the periphery of the auxiliary runner 23 with one strut per dome rib. The strut 24 is hinged at the other end to each stretcher 27 at a median point thereof 25.

The outer dome rib section II includes a pivot bracket 5 hinged to the end of the dome rib section *a* of group I at 2' . The bracket 5 has an extension beyond the dome rib hinge 2' and subtends a pivot pin 12 to which is hinged the end 11' of a control link 11. The inner end of the control link 11 is hinged to the stretcher 7 at pivot point 10 spaced a short distance from the hinge point 8 of the stretcher 7 with the geats 9.

As can be seen, a quadrilateral is formed between that control link 11, the dome rib section *a*, the length of the stretcher between the hinge points 10 and 8, and the length of the bracket 5 extension between the hinge points 12 and 2' . The articulation of this quadrilateral would normally control the folding or pivoting action of the outer dome rib section II. In the present case, as shown in FIGS. 4 and 5, there is provided a further geats member G sliding on the dome rib section *b* between the geats 9 and the bushing 27. The inner end of the dome rib section *a* is bent at 30 to be locked in engagement within an aperture 29 of the lower legs 26 and 26' of the geats G.

When the dome ribs are being opened, the runner 6 is moved on the stick towards the crown 4, and the stretcher 7 will push the geats 9 on the dome rib section *b* while at the same time pivoting the dome rib upwardly intil the geats 9 abuts the geats G while in turn abuts the bushing 27 at 27' as shown in FIG. 4. The runner 6, however, has not reached its final destination, and as the runner 6 continues to move upwardly until the lever 13 engages the opening 14''' in the stick, the stretcher 7 will continue to pivot about the pivot point 8 pulling under tension the control link 11 which will cause the dome rib section *a* to arch outwardly in a convex manner.

When it is required to collapse the umbrella, the main runner 6 is released from the aperture 14''' and moved along the stick 3 away from the crown 4. First of all, the tension in control link 11 is thus released as the stretcher 7 pivots about pivot point 8 and pivot point 10. As the runner continues downwardly, the stretcher continues to pivot about pivot point 10, moving the geats 9 along the dome rib section *b* towards the crown. In this manner, the dome rib sections are not collapsed since there is no compression force on the control link 11, and there is no force acting against the geats G or the dome rib section *a* to collapse it within the dome rib section *b*.

Figure 2:
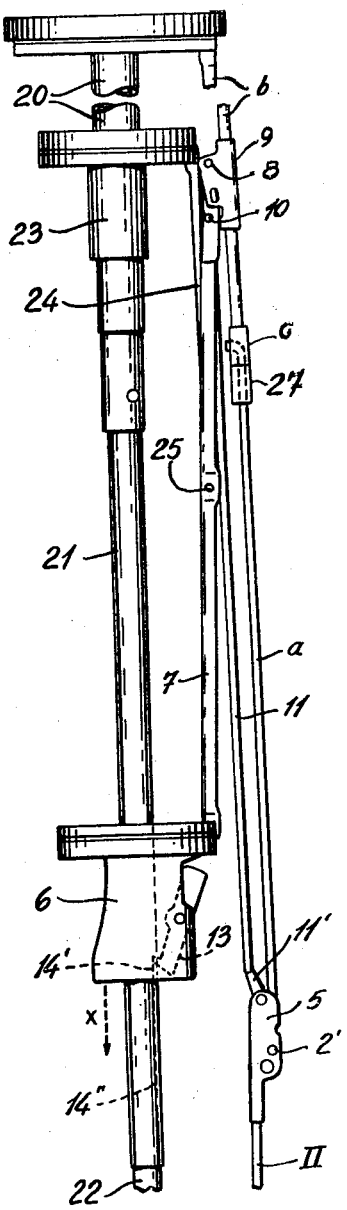
FIG. 2 is a fragmentary elevational view of the umbrella in an intermediate closed position.
Figure 3:
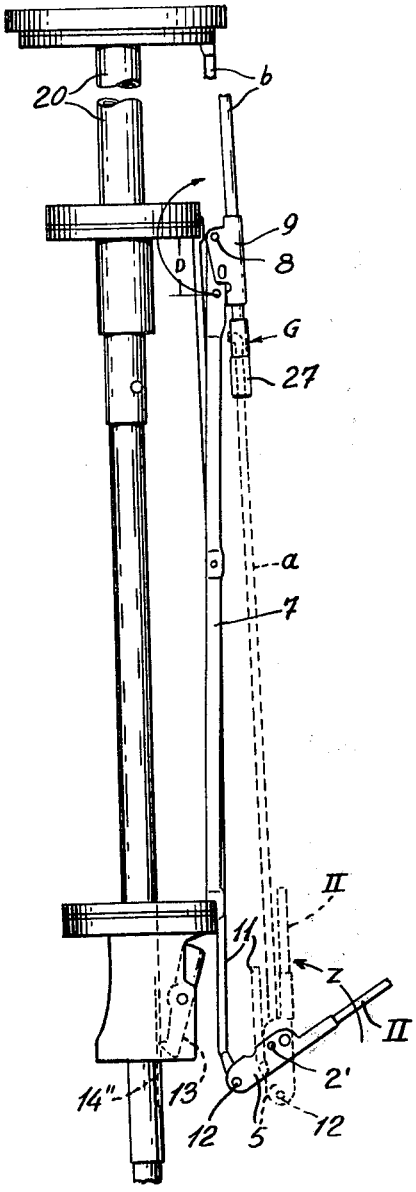
FIG. 3 is an elevational view, similar to FIG. 2, showing a still further step towards closing the umbrella.

As the runner 6 attains the position shown in FIG. 2, the lever 13 will be latched in the aperture 14', and the dome ribs will be parallel to the stick 3. If it is required to fully collapse the umbrella, the lever 13 will be disengaged from aperture 14' and will be moved further in the direction X away from the crown. Since in FIG. 2 the quadrilateral is fully collapsed and since the stretcher 7 and strut 24 are almost aligned, further movement of the runner 6 will pull the geats 9 downwardly on the dome rib section *b* causing a compression force along the control link 11, forcing the extension of bracket 5 and the dome rib section II to pivot about the pivot point 2', as shown in FIG. 3 in the direction of arrow Z. When the section II is fully folded onto the dome rib section *a* , the dome rib sections *a* and *b* as well as the stick can now be shortened telescopically with the same manual movement.

Bent end 11' of the control link 11 is adapted to save a considerable amount of space in storing the dome rib parts. At hinge 10 the control link 11 may be arranged laterally of the stretcher 7 to save space when the umbrella is in a folder condition A compression spring F may be arranged as shown in FIG. 6 on dome rib section *b* between the geats 9 and G. The compression spring applies against geats 9 a load in the direction of the crown 4. As a result, the dome rib is not held too near the stick only in the folded position, but part II of the dome rib is also locked to part I in the extended position. The dimensions of spring F are such that it becomes completely compressed just before reaching the open position to produce the inherent arching of the dome rib section *a* explained previously.

I claim:

1. An umbrella frame comprising a stick, a crown fixed at one end of the stick, a plurality of dome ribs hinged from the periphery of the crown, a main runner slidable on the stick, each dome rib including an inner and a middle section telescopic within the inner section, and an outer section hingedly connected to the outer end of the middle seciton for movement between a position colinear with the middle section and a position with the outer section folded over the middle section, a first geats slidable on the inner section, a stretcher member hinged to the main runner at one end thereof and to the geats at the other end thereof, a second geats member slidable on the inner section and connected to the end of the middle dome rib section, an auxiliary runner slidable on the stick between the main runner and the crown, a strut member hinged to the auxiliary runner and to the stretcher member, and a control link hinged to the stretcher member a short distance from the hinge point with the first geats at one end thereof and at the ohter end the control member is hingedly connected to an inner extension of the outer dome rib section to form a quadrilateral with the middle dome rib section, the inner extension of the outer section and a portion of the stretcher member between the hinge point of the control link and the first geats, whereby as the main runner is slid on the stick away from the crown, the dome rib section can pivot downwardly to a position parallel with the stick as the first geats member slides on the inner dome rib section, allowing the quadrilateral to be collapsed leaving the middle dome rib section and the outer dome rib section fully extended, and as the runner is further moved on the stick to a position beyond the length of the strut member, it will cause the geats to slide on the dome rib section away from the crown, and the control link will cause the outer dome rib section to fold onto the middle dome rib section.

2. An umbrella frame as defined in claim 1, wherein the middle dome rib section is of circular rod shape and the inner end thereof is bent at 90°, the second geats is of cylindrical tubular shape adapted to slide on the inner dome rib section and includes an aperture in the wall of the tube adapted to receive and engage the bent inner end of the middle dome rib section.

3. An umbrella as defined in claim 1, wherein an intermediate locking position is provided for the main runner coinciding with the position of the runner when the dome ribs are fully extended but extend parallel to the stick and that a final locking position is provided on the stick for the main runner when the runner has been pulled away from the crown such that the outer dome rib sections have pivoted and are folded over the main dome rib section.

4. An umbrella frame as defined in claim 1, wherein a bearing member is provided at the end of the inner section of the dome rib to which the middle dome rib section is adapted to slide.

5. An umbrella frame as defined in claim 4, wherein a compression spring is provided between the second geats and the bearing member on the inner dome rib section.

* * * * *